US009620910B2

(12) United States Patent
Chen

(10) Patent No.: US 9,620,910 B2
(45) Date of Patent: Apr. 11, 2017

(54) CABLE CONNECTOR

(71) Applicant: ALLTOP ELECTRONICS (SUZHOU) LTD., Taicang, JiangSu Province (CN)

(72) Inventor: Yi-Chang Chen, Jhonghe (TW)

(73) Assignee: ALLTOP ELECTRONICS (SUZHOU) LTD., Taicang, Jiangusu Province (CN)

( * ) Notice: Subject to any disclaimer, the term of this patent is extended or adjusted under 35 U.S.C. 154(b) by 0 days.

(21) Appl. No.: 14/926,849

(22) Filed: Oct. 29, 2015

(65) Prior Publication Data

US 2017/0033512 A1 Feb. 2, 2017

(30) Foreign Application Priority Data

Jul. 30, 2015 (CN) ..... 2015 1 0460031

(51) Int. Cl.
*H01R 3/00* (2006.01)
*H01R 13/66* (2006.01)
*H01R 13/6581* (2011.01)

(52) U.S. Cl.
CPC ..... *H01R 13/665* (2013.01); *H01R 13/6581* (2013.01)

(58) Field of Classification Search
CPC .... H01R 23/688; H01R 12/79; H01R 23/662; H01R 13/65802; H01R 13/658; H01R 23/7073
USPC ..... 439/101, 108, 493, 497, 607.27, 607.41, 439/607.46, 607.51, 607.58, 660
See application file for complete search history.

(56) References Cited

U.S. PATENT DOCUMENTS 7,090,534 B2 * 8/2006 Wu ..... H01R 9/032 439/607.41
7,341,487 B2 * 3/2008 Wu ..... H01R 13/6658 439/497
7,410,366 B2 * 8/2008 Wu ..... H01R 13/6658 439/660
7,462,071 B1 * 12/2008 Wu ..... H01R 9/032 439/497
7,632,155 B1 * 12/2009 Wu ..... H01R 9/035 439/497
7,758,374 B2 * 7/2010 Yu ..... H01R 4/027 439/493
7,955,132 B2 * 6/2011 Luo ..... H01R 12/62 439/607.41
8,398,427 B2 * 3/2013 Wu ..... H01R 4/02 439/497

(Continued)

*Primary Examiner* — Thanh Tam Le
(74) *Attorney, Agent, or Firm* — Sughrue Mion, PLLC

(57) ABSTRACT

A cable connector includes an insulative housing, a number of contacts, an internal circuit board and a flat cable. The contacts are arranged in two rows. Each contact has a retaining portion retained in the insulative housing, a contact portion and a connecting portion extending from two ends of the retaining portion. The internal circuit board has a plurality of first golden fingers at one end thereof and a plurality of second golden fingers at another end thereof. The first golden fingers connect with the connecting portions of the contacts. The second golden fingers electrically connect with the first golden fingers. The flat cable has a plurality of wires corresponding to and connecting with the second golden fingers and a coating retaining at outside of the wires. All wires are arranged in a row.

15 Claims, 9 Drawing Sheets

(56) References Cited

U.S. PATENT DOCUMENTS

| | | | | |
|---|---|---|---|---|
| 8,562,378 | B2 * | 10/2013 | Su | H01R 13/502<br>439/607.55 |
| 8,777,664 | B2 * | 7/2014 | Gui | H01R 13/6471<br>439/607.25 |
| 8,784,134 | B2 * | 7/2014 | Wu | H01R 13/6598<br>439/607.05 |
| 8,794,995 | B2 * | 8/2014 | Wu | H01R 12/598<br>439/497 |
| 9,214,767 | B1 * | 12/2015 | Yu | H01R 13/6585 |

* cited by examiner

CABLE CONNECTOR

BACKGROUND

1. Technical Field

The present disclosure relates to a cable connector, and more particularly to a cable connector with flat cable for soldering conveniently.

2. Description of Related Art

Cable connector presents as a media used for electrically connecting two electronic devices and transmitting signals therebetween. A conventional cable connector includes a connector part and a cable part connecting with the connector. The connector part has a number of contacts and an insulative housing supporting the contacts. The cable part includes a number of wires for electrically connecting with the contacts. The cable part of the conventional cable connector is cylindrical and the wires are received in a cylindrical insulative coating. Because of the limited receiving space, the wires need to use thin coaxial lines, while the thin coaxial lines cost too much. Besides, because the contacts are arranged in rows, the wires in the cylindrical insulative coating should be exposed outside and arrayed in corresponding rows to solder with the contacts. Thereby it is inconvenient for soldering, and the wires may be contact with each other in the arraying process.

It is desirable to provide an improved cable connector for solving above problems.

SUMMARY

In one aspect, the present invention includes a cable connector. The cable connector includes an insulative housing defining a mating space for receiving a mating connector, a plurality of contacts arranged on the insulative housing in two rows, an internal circuit board and a flat cable. Each row of the contacts have two grounding contacts at two lateral sides thereof, two pairs of differential signal contacts between the grounding contacts, and the differential signal contacts in two rows are identical in signal transmission and arranged reversely. Each contact has a retaining portion retained in the insulative housing, a contact portion extending into the receiving space from one end of the retaining portion, a connecting portion extending from another end of the retaining portion. The internal circuit board has a plurality of first golden fingers and a plurality of second golden fingers at opposite two ends thereof, the first golden fingers connecting with the connecting portions, and the second golden fingers electrically connecting with the first golden fingers. The flat cable has a plurality of wires connecting with the second golden fingers and a coating retaining at outside of the wires. All wires are arranged in a row and the center axes of all wires are located in a same plane.

In another aspect, the present invention also includes a cable connector which comprises an insulative housing, a plurality of contacts arranged on the insulative housing and a flat cable. Each contact has a retaining portion retained in the insulative housing, a contact portion extending into the receiving space from one end of the retaining portion, a connecting portion extending from another end of the retaining portion. The flat cable has a plurality of wires electrically connecting with the connecting portions and a coating retaining at outside of the wires. All wires are arranged in a row and the center axes of all wires are located in a same plane.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
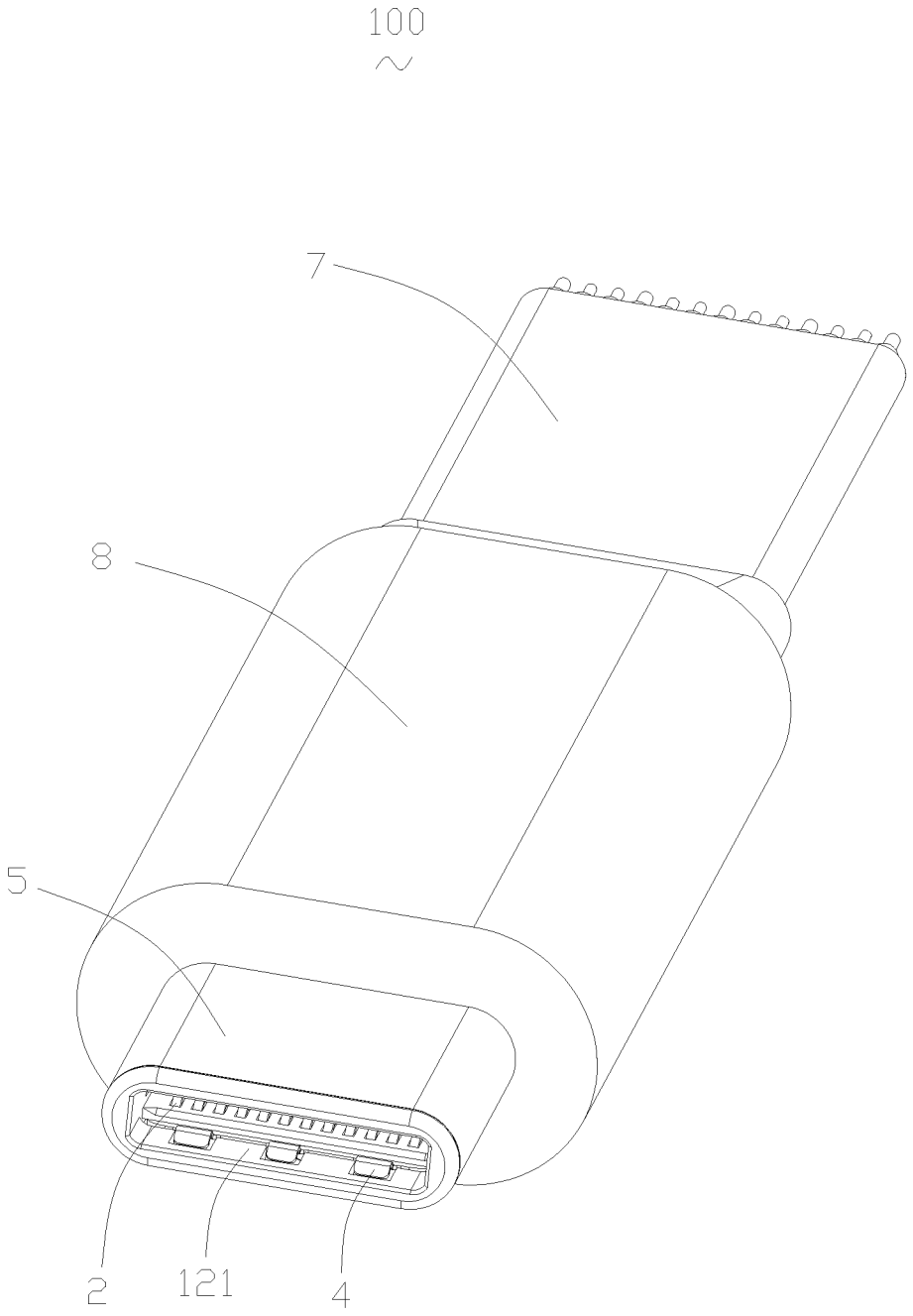
FIG. 1 is a perspective view of a cable connector in accordance with an illustrated embodiment of the present disclosure.

Reference will now be made to the drawing figures to describe the embodiments of the present disclosure in detail. In the following description, the same drawing reference numerals are used for the same elements in different drawings.

Referring to FIGS. 1 to 9, an illustrated embodiment of the present disclosure discloses a cable connector 100 comprises an insulative housing 1, a plurality of contacts 2 and a grounding member 3 retained in the insulative housing 1, a pair of shield blades 4 respectively located at upper and lower sides of the insulative housing 1, an outer shield 5 surrounding the insulative housing 1, an internal circuit board 6 located at a rear side of the insulative housing 1, a flat cable 7 connecting the internal circuit board 6 and a protective sleeve 8.

Figure 5:
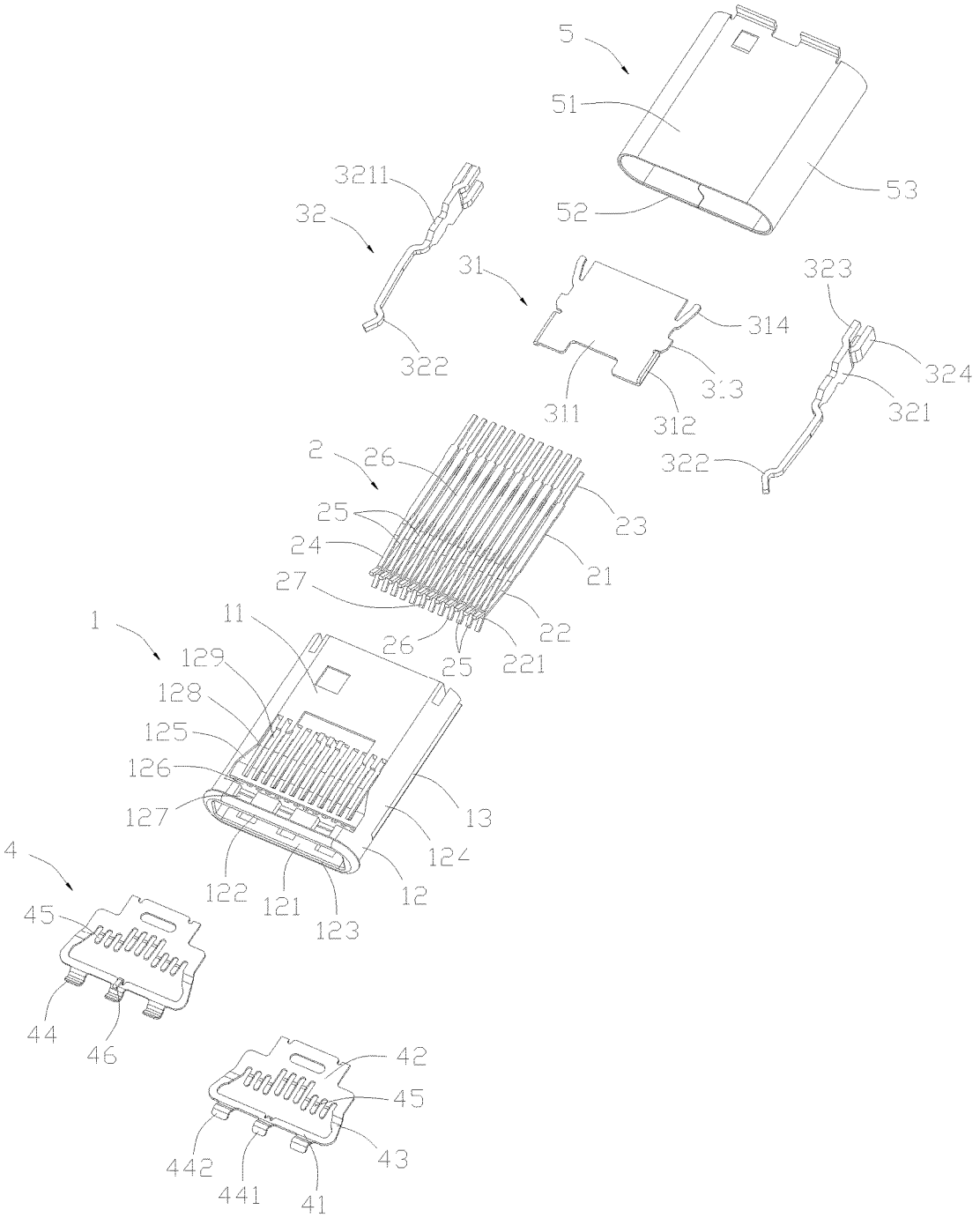
FIG. 5 is a partially exploded view of the cable connector shown in FIG. 4.
Figure 6:
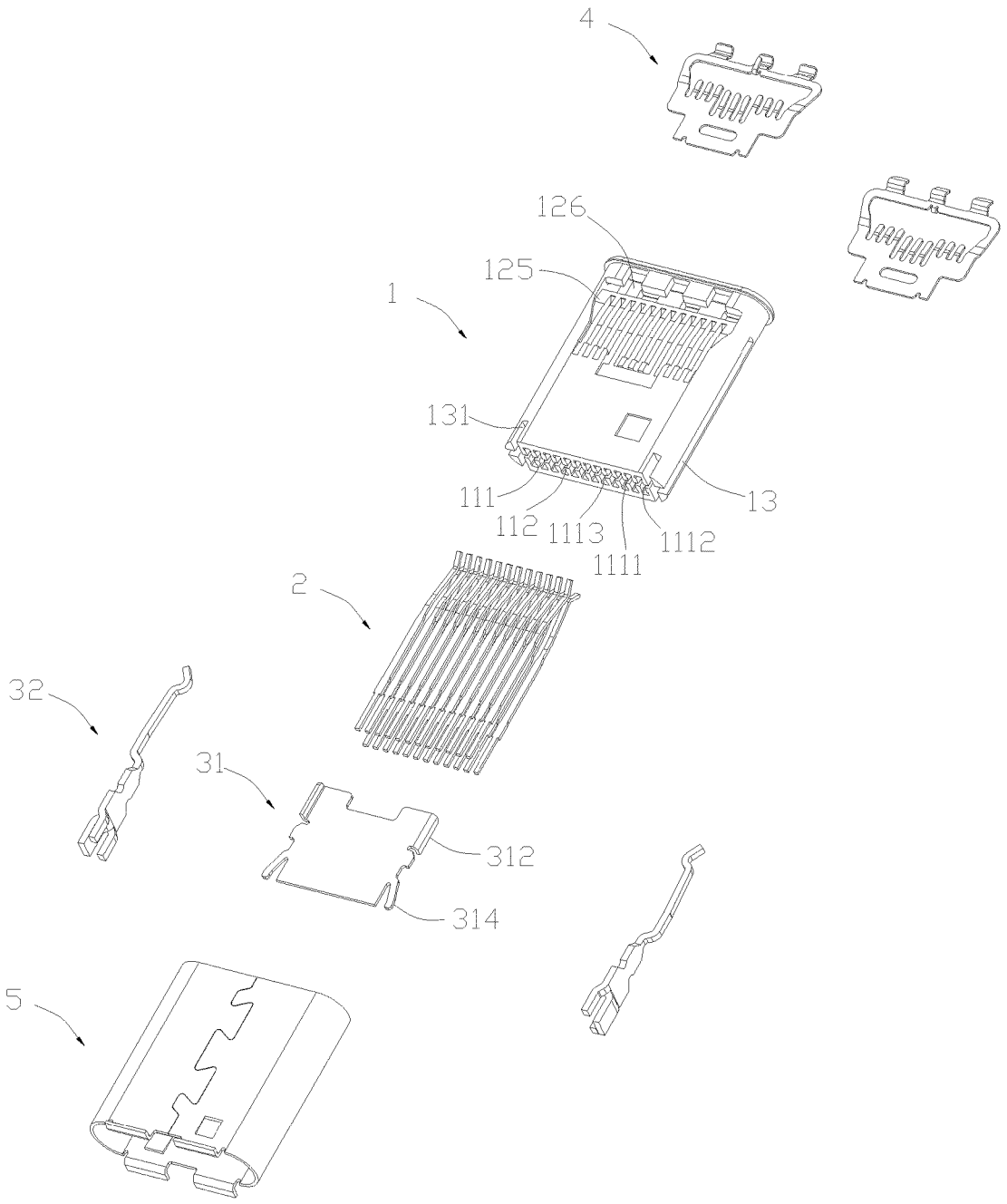
FIG. 6 is a view similar to FIG. 5, while viewed from another aspect.
Figure 7:
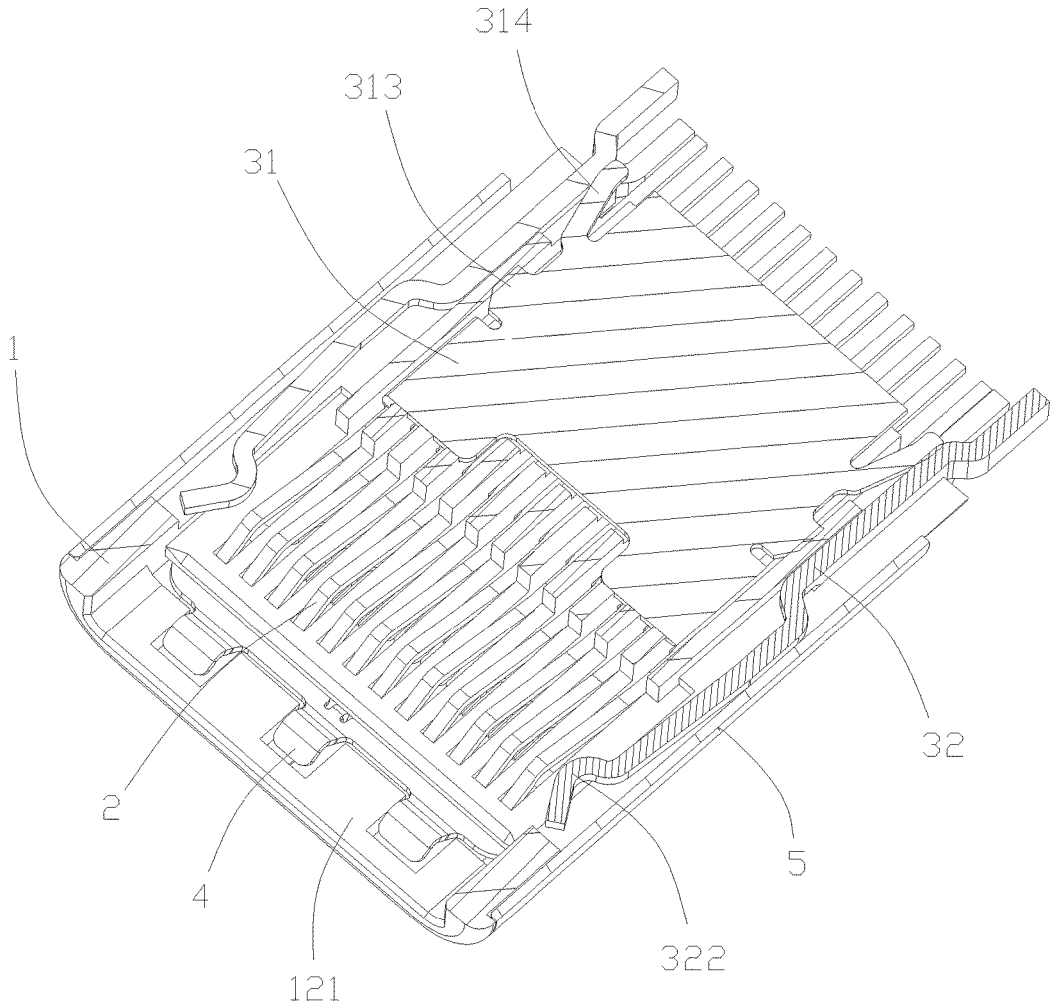
FIG. 7 is a cross-sectional view of the cable connector shown in FIG. 4 along a transverse direction.

Referring to FIGS. 5 and 6, the insulative housing 1 is provided with a body portion 11 and a mating portion 12 forwardly extending from the body portion 11. The body portion 11 defines a contact receiving portion and a middle slot 112 all of which open backwardly. The middle slot 112 does not extend through the body portion 11 forwardly. The mating portion 12 is elliptic and provided with a top wall 122, a bottom wall 123, a pair of side walls 124 and a mating space 121 formed therebetween. The mating space 121 opens forwardly.

In the present embodiment, the contact receiving portion composes of a plurality of passageways 111. The passageways 111 extend through the body portion 11 along a front to back direction. The middle slot 112 separates the passageways 111 into two parts which comprise upper passageways 1111 and lower passageways 1112. The contact 2 are arranged in two rows and retained in corresponding upper and lower passageways 1111, 1112 respectively. Each passageway 111 is provided with a pair of securing recesses 1113 further depressed from two inner side walls thereof. Each contact 2 has a securing portion 21 retained in the securing recesses 1113, a contact arm 22 forwardly extending into the mating space 121 and a connecting portion 23 backwardly extending out of the body portion 11. The contact arm 22 possesses a V-shaped contact portion 221 provided at a free end thereof. The contact portions 221 in two rows are located at upper and lower sides of the mating space 121 respectively and face to each other, therefore, a tongue of a mating connector (not shown) will be sandwiched between the contact portions 221.

The insulative housing 1 is further provided with a pair of elongated slots 13 at two sides thereof and a pair of notches 131 respectively formed at a rear portion of the elongated slots 13. The notches 131 are recessed upwardly and downwardly from inner surfaces of the elongated slots 13. The elongated slots 13 open sideward. In a transverse direction, the elongated slots 13 communicate with the mating space 121 at a front side thereof and communicate with the middle slot 112 at a rear side thereof.

Each of the top wall 122 and bottom wall 123 defines a recess 125 recessed from the outer surfaces thereof, an indention 126 communicating the recess 125 and the mating space 121, a plurality of apertures 128 extending therethrough along an up to down direction and a plurality of stalls 129 between adjacent apertures 128. The apertures 128 communicate with the recesses 125 and locate behind the indentions 126. The contact portions 221 correspond to the apertures 128 along the up to down direction, therefore, the apertures 128 can supply a floating space to the contact portions 221, and the mating connector would be inserted conveniently. The indention 126 extends through the top wall 122 or bottom wall 123 along a transverse direction. Besides, each of the top wall 122 and bottom wall 123 further defines a plurality of cutouts 127. The cutouts 127 are recessed forwardly from the front inner surfaces of the indentions 126.

Referring to FIGS. 1 to 8, the arrangement of the contacts 2 conforms to that of the standard USB type-c plug connector, and each row of the contacts 2 have two grounding contacts 25 at two lateral sides, two pairs of differential signal contacts 25 adjacent to the grounding contacts 25, two power contacts 26 adjacent to the differential signal contacts 25 and four low frequency signal contacts 27 between the power contacts 26. The contacts 2 in two rows are identical in signal transmission except that they are arranged reversely, thereby the mating connector can mate with the cable connector 100 in the pros and cons.

Figure 4:
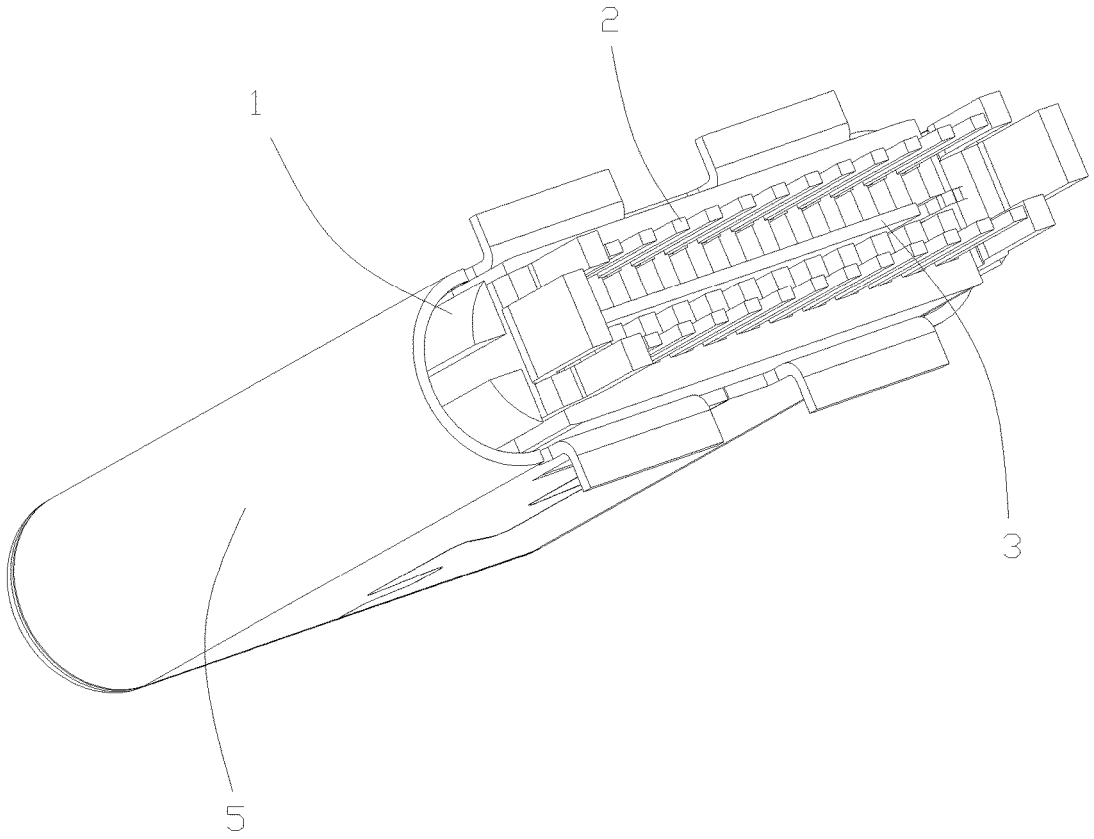
FIG. 4 is a perspective view of the cable connector shown in FIG. 1, while removing a protective sleeve, an internal circuit board and a flat cable thereof.
Figure 8:
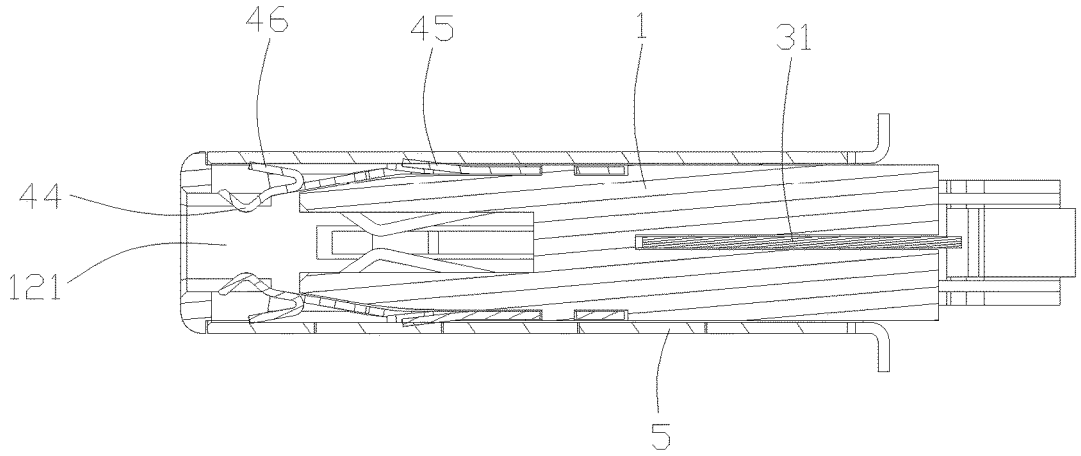
FIG. 8 is a cross-sectional view of the cable connector shown in FIG. 4 along a longitudinal direction.
Figure 9:
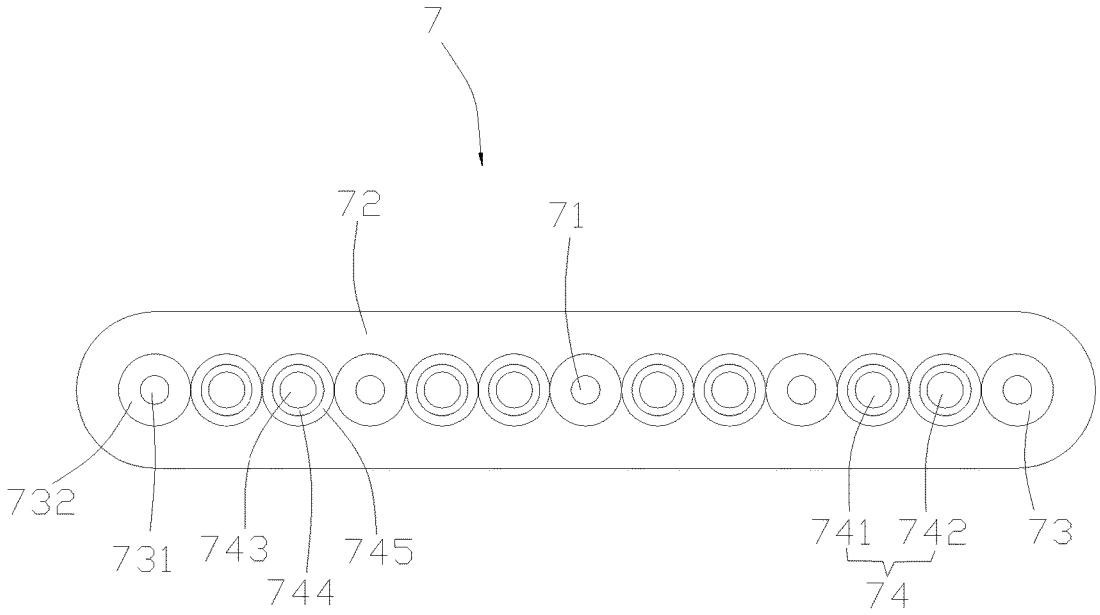
FIG. 9 is a cross-sectional view of the flat cable of the cable connector shown in FIG. 1.

Referring to FIGS. 1, 4 and 8, the grounding member 3 is provided with a middle grounding plate 31 and a pair of locking arms 32 projecting into the mating space 121. The middle grounding plate 31 is fixed in the body portion 11, and spaces apart from the contacts 2 along the up to down direction. In the preferred embodiment of the present invention, the middle grounding plate 31 and the locking arms 32 are molded separately. The middle grounding plate 31 is positioned in the middle slot 112. The locking arms 32 are arranged at two sides of the middle grounding plate 31 and secured in the elongated slots 13. The locking arms 32 electrically connect with the middle grounding plate 31. While in an alternative embodiment, the middle grounding plate 31 and the locking arms 32 can be molded integrally also.

The middle grounding plate 31 is provided with a plate portion 311, a pair of bending portions 312 upwardly or downwardly bending from the front two sides thereof, a plurality of barbs 313 outwardly extending from two sides thereof, and a pair of resilient strips 314 extending outwardly from rear two sides thereof. The plate portion 311 is received in the middle slot 112. The barbs 313 engage with the inner side walls of the middle slot 112 for fixing the middle grounding plate 31 to the body portion 11. The free ends of the bending portions 312 extend to the passageways 111 and contact with the grounding contacts 25, therefore the middle grounding plate 31 can prevent the upper and lower rows of contacts 2 from interfering with each other and performance to prevent EMI between the two rows of the contacts 2. The resilient strips 314 protrude into the elongated slots 13 to contact with the locking arms 32. The resilient strips 314 and the plate portion 311 form gaps therebetween. The gaps can supply deforming space for the resilient strips 314.

Each of the locking arm 32 is provided with an intermediate portion 321 retained in the notches 131, a locking portion 322 extending forwardly from the intermediate portion 321, a grounding tab 323 inwardly extending from a rear end of the intermediate portion 321, and a limiting tab 324 outwardly extending from a rear end of the intermediate portion 321. The intermediate portion 321 is provided with a number of barbs 3211 to engage with the inner walls of the notches 131. The resilient strips 314 of the middle grounding plate 31 abut against the intermediate portion 321. The grounding tabs 323 connect with the grounding contacts 25 or the internal circuit board 6. As described above, the locking arm 32 can not only be used to lock the mating connector, but also to prevent EMI in the mating space 121. The limiting tabs 324 resist two sides of the internal circuit board 6 to limit the internal circuit board 6 from moving along a transverse direction.

The shield blades 4 are located at outside of the receiving space 12 and space apart from the contacts 2 along the up to down direction. In detail, the shield blades 4 are received in the recesses 125 of the upper and lower walls 122, 123. Each of the shield blades 4 is formed with a front bracket 41, a rear bracket 42, a pair of side brackets 43, a plurality of inner grounding arms 44 and a plurality of outer grounding arms 45 extending beyond the upper or lower walls 122, 123. The front bracket 41 is received in the indentions 126. The rear bracket 42 is located behind the apertures 128. The inner grounding arms 44 extend forwardly and inwardly from the front bracket 41, and protrude into the mating space 121 through the indentions 126. The outer grounding arms 45 extend forwardly and outwardly from the rear bracket 42. The outer grounding arms 45 are located at outside of the stalls 129 and correspond to the stalls 129 along the up to down direction. Therefore, the outer grounding arms 45 are located between adjacent contacts 2 along the transverse direction to prevent disturb or EMI between adjacent contacts 2.

The inner grounding arms 44 comprise a pair of external arms 442 at two sides and an internal arm 441 between the external arms 442. Besides, each shield blade 4 is further provided with a resisting arm 46 outwardly extending from the front bracket 41, and the resisting arm 46 corresponds to the internal arm 441 along the up to down direction.

The outer shield 5 has an upper wall 51, a lower wall 52 and a pair of connecting walls 53 connecting two sides of the upper wall 51 and the lower wall 52. The outer grounding arms 45 resist the upper wall 51 or the lower wall 52 outwardly.

Figure 2:
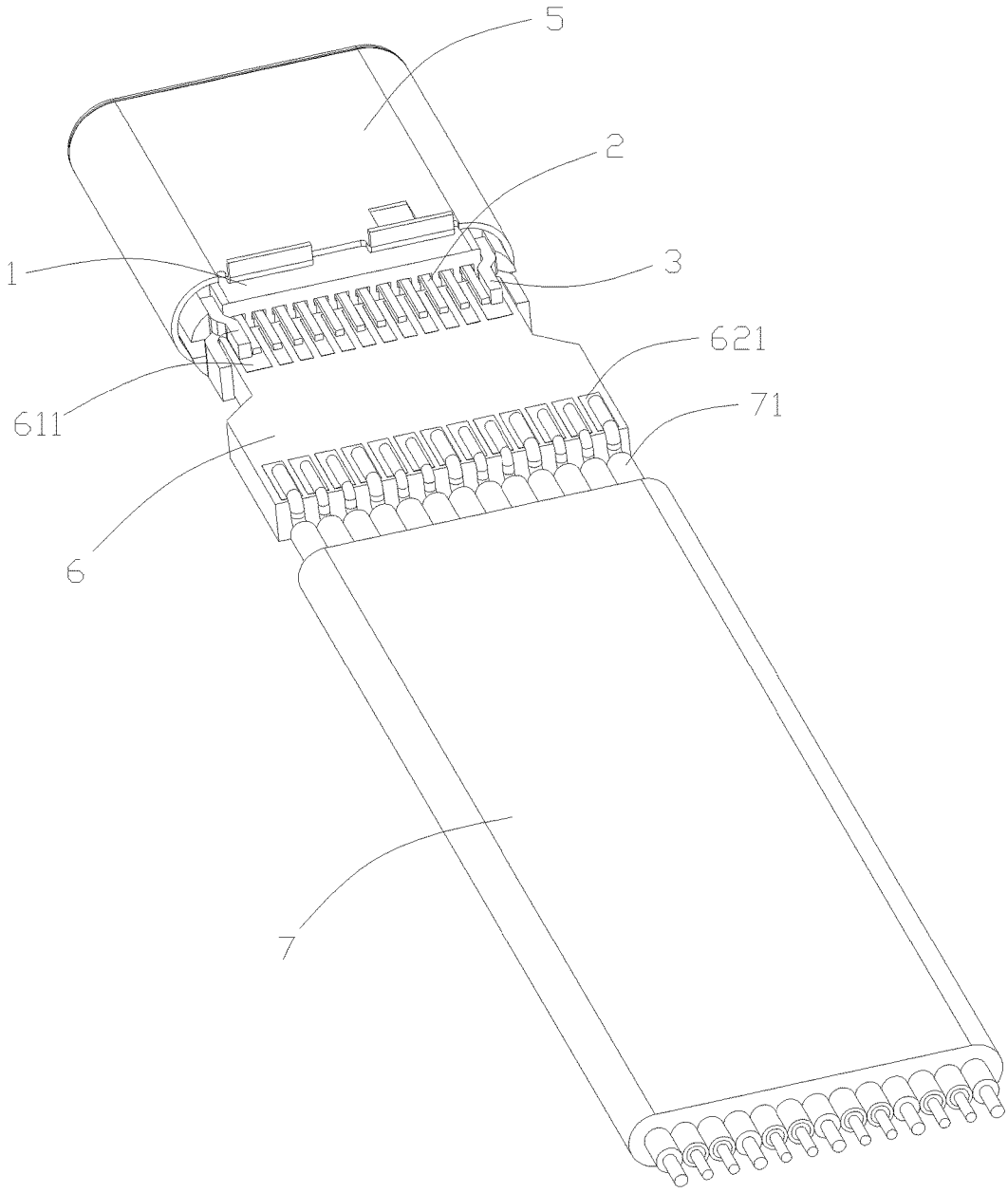
FIG. 2 is a perspective view of the cable connector shown in FIG. 1, while removing a protective sleeve thereof.
Figure 3:
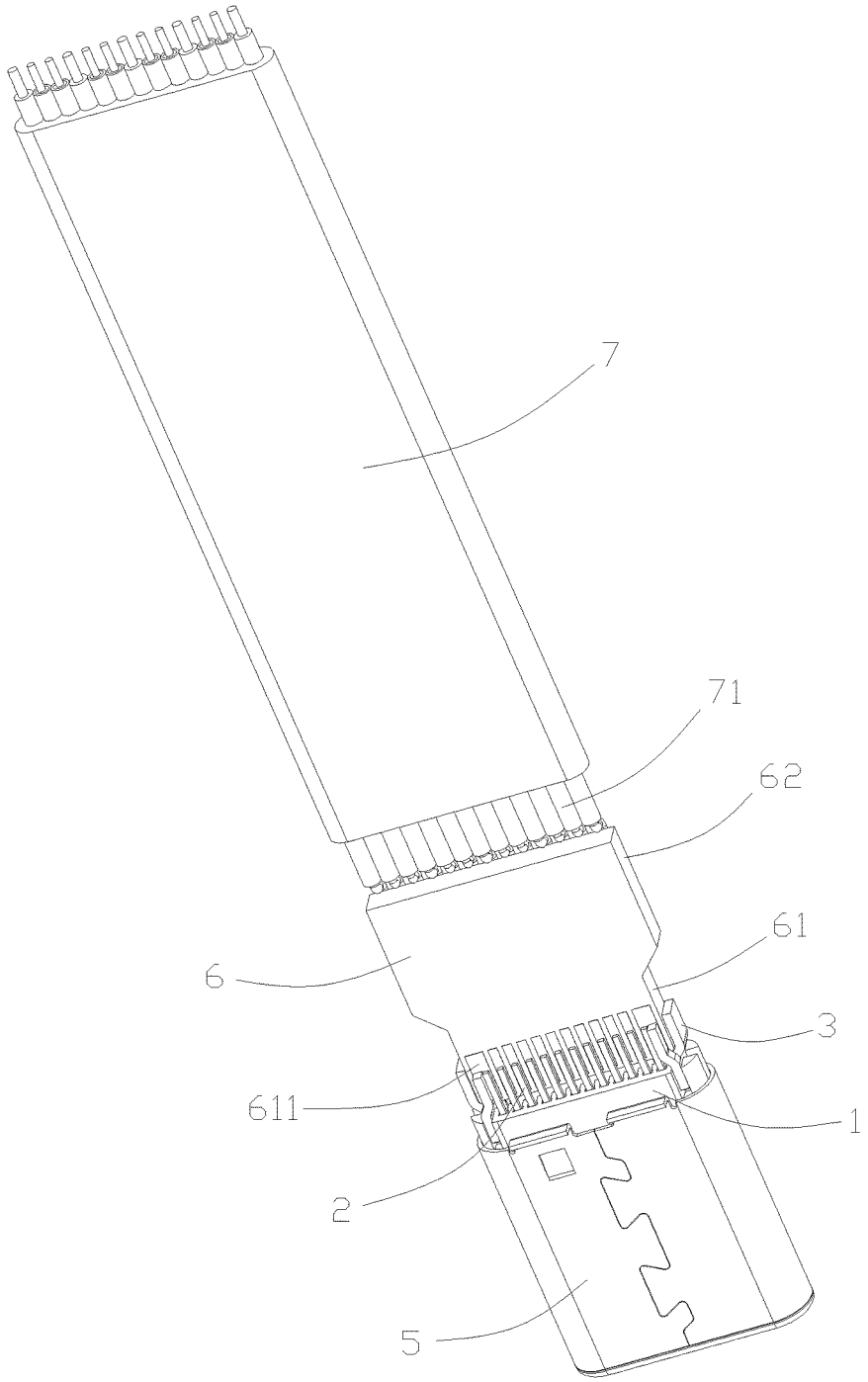
FIG. 3 is a view similar to FIG. 2, while viewed from another aspect.

Referring to FIGS. 1 to 3, the internal circuit board 6 has a front end 61 connecting with the contacts 2 and a rear end 62 connecting with the flat cable 7. The rear end 62 is wider than the front end 61, which is convenient for arranging and soldering the flat cable 7.

The front end 61 is provided with a plurality of first golden fingers 611 at top and bottom sides thereof. The first golden fingers 611 correspond to and connect with the connecting portions 23 one to one. Thereby the arrangement of the first golden fingers 611 is same to that of the contacts 2. The rear end 62 is provided with a plurality of second golden fingers 621 at the top side thereof. The grounding tabs 323 of the locking arms 32 are soldered with the lateral first golden fingers 621. The second golden fingers 621 electrically connect with the first golden fingers 611 by conductive lines in the internal circuit board 6.

Because the first golden fingers 611 at top and bottom sides of the front end 61 are identical in signal transmitting, the first golden fingers 611 transmitting same signal can be designed to connect with at least one second golden finger 621 commonly. For example, four lateral first golden fingers 611 used to transmitting grounding signal can connect to one or two second golden finger 621 commonly. Then the second golden fingers 621 are decreased, which is convenient for soldering the flat cable 7. Besides, the connection between the first and second golden fingers 611, 621 can be adjusted according to the requirement, and the arrangement of the second golden fingers 621 can be adjusted also. For example, the first golden fingers 611 which transmit differential signal connect with the second golden fingers 621 by conductive lines one to one for supplying multi-channel high-frequency signal transmission, the other second golden fingers 621 selectively connect with the other first golden fingers 611 according to the requirement.

Please to FIGS. 1 to 3 and 8, the flat cable 7 comprises a plurality of wires 71 corresponding to and connecting with the second golden fingers 621 and a coating 72 retained at outside of the wires 71. All wires 71 are arranged in a row in the coating 72, and the center axes of all wires 71 are located in a same plane. Therefore, the flat cable 7 can be soldered with the second golden fingers 621 directly and conveniently. Besides, the wires 71 do not use thin coaxial line, thereby the cost of the flat cable 7 can be decreased.

The wires 71 comprise a plurality of wire sets 74 and a plurality of third wires 73. Each wire set 74 has a first wire 741 and a second wire 742 adjacent to each other and present as a differential pair. Each of the first wire 741 and second wire 741 is provided with a first conductor 743 at center position thereof, a first layer 744 wrapping the first conductor 743 and a second layer 745 wrapping the first layer 744.

The dielectric coefficient of the first layer 744 is lower than that of the second layer 745. In detail, in the present embodiment, the dielectric coefficient of the first layer 744 is close to that of the air. Thereby the first layer 744 has small impedance, which can not only provide a better signal transmitting environment, but also reduce the delay of signal transmission, and reduce crosstalk between adjacent wires 71 to ensure effective transmission of high speed signals. Besides, the second layer 745 is wave-absorbing layer, which can absorb electromagnetic wave, effectively suppress external electromagnetic interference, effectively cut off the first conductor 743 from outside and ensure high-frequency or super high-frequency signal transmission. In addition, the absorbing layer 745 is light, and is resistant to temperature, moisture and corrosion, etc., that can effectively protect the first conductor 743 inside and extend the life of the flat cable 7.

The third wires 73 are arranged at two sides of the wire sets 74. Each wire set 74 is arranged with two third wires 73 at two sides thereof. Each third wire 73 has a second conductor 731 at the center position thereof and a third layer 732 wrapping the second conductor 731. The diameter of the second conductor 731 is different from that of the first conductor 743, which means that the diameter of the second conductor 731 can be designed to be larger or smaller than that of the first conductor 743 according to the impedance matching between the first and second wires 741, 742.

The coating 72 retains all wires 71 together, and can be designed to be a wrapping layer wrapping the wires 71 or two films covering the upper and lower sides of all wires 71. The material of the coating 72 is different from that of the first layer 744 and the second layer 745.

The flat cable 7 is installed to the internal circuit board 6 as follows: firstly, removing a front portion of the coating 72 to expose the first and second conductors 743, 731; secondly, bending the first and second conductors 743, 731 to Z-type; thirdly making the front free ends of the first and second conductors 743, 731 contact with the second golden fingers 621, and making the middle portion connecting with the front free ends of the first and second conductors 743, 731 resist the rear end surface of the internal circuit board 6, therefore, the flat cable 7 behind the middle portion are located at the middle position along a thickness direction of the internal circuit board 6; then soldering the front free ends of the first and second conductors 743, 731 and the second golden fingers 621 together; finally, installing the protective sleeve 8 to the outside of the connection portion of the insulative housing 1, the internal circuit board 6 and the flat cable 7.

As described above, the wires 71 of the flat cable 7 can be conveniently soldered with the second golden fingers 621. Besides, the flat cable 7 can be produced easily and have lower cost.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A cable connector, comprising:

a single piece insulative housing defining a mating space for receiving a mating connector;

a plurality of contacts arranged on the insulative housing in two rows, each row of the contacts having two grounding contacts at two lateral sides thereof, two pairs of differential signal contacts between the grounding contacts, the differential signal contacts in two rows being identical in signal transmission and arranged reversely, each contact having a retaining portion retained in the insulative housing, a contact portion extending into the receiving space from one end of the retaining portion, a connecting portion extending from another end of the retaining portion;

an internal circuit board having a plurality of first golden fingers and a plurality of second golden fingers at opposite two ends thereof, the first golden fingers connecting with the connecting portions, and the second golden fingers electrically connecting with the first golden fingers; and a flat cable having a plurality of wires connecting with the second golden fingers and a coating retaining at outside of the wires, all wires being arranged in a row and the center axes of all wires being located in a same plane;

wherein the flat cable is provided with a wire set, and the wire set is provided with a first wire and a second wire which present as differential pair, each of the first wire and second wire is provided with a first conductor, a first layer wrapping the first conductor and a second layer wrapping the first layer, and the dielectric coefficient of the first layer is lower than that of the second layer.

2. The cable connector as claimed in claim 1, wherein the second layer is wave-absorbing layer.

3. The cable connector as claimed in claim 1, wherein the flat cable is provided with at least two third wires located at two sides of the wire set, each third wire has a second conductor and a third layer wrapping the second conductor, and the diameter of the second conductor is different from that of the first conductor.

4. The cable connector as claimed in claim 1, further comprising a grounding member, wherein the grounding member has a middle grounding plate retained in the insulative housing and a pair of locking arms projecting into the mating space, the middle grounding plate is located between two rows of the contacts, and the locking arms electrically connecting with the middle grounding plate.

5. The cable connector as claimed in claim 4, wherein the middle grounding plate has at least a bending portion upwardly or downwardly extending to engage with the grounding contact.

6. The cable connector as claimed in claim 4, wherein the insulative housing has a body portion and a mating portion forwardly extending from the body portion, the mating space is formed in the mating portion and opens forwardly, the body portion defines a middle slot and a contact receiving portion opening backwardly, the middle grounding plate is received in the middle slot, and the contacts are retained in the contact receiving portion.

7. The cable connector as claimed in claim 4, wherein the insulative housing further defines a pair of elongated slots at two sides thereof, and the locking arms are received in the elongated slots, the elongated slots communicating with the mating space at a front side thereof and communicating with the middle slot at a rear side thereof.

8. The cable connector as claimed in claim 4, wherein the middle grounding plate and the locking arms are molded separately, and the locking arms are arranged at two sides of the middle grounding plate, the middle grounding plate having a pair of resilient strips extending outwardly from two sides thereof, each locking arm being provided with an intermediate portion abutting against the resilient strip, a locking portion extending forwardly from the intermediate portion and a grounding tab extending from a rear end of the intermediate portion, the grounding tab soldering with the first golden finger.

9. The cable connector as claimed in claim 1, wherein the insulative housing has a body portion and a mating portion forwardly extending from the body portion, the mating portion is provided with a top wall, a bottom wall and two side walls surrounding the mating space, and the cable connector further comprises:

a pair of shield blades locating at outside of the mating space, each shield blade having a plurality of inner grounding arms and outer grounding arms, the inner grounding arms protruding into the maing space, and the outer grounding arms protruding beyond the top wall or bottom wall; and an outer shield surrounding the insulative housing, the outer shield having an upper wall, a lower wall and a pair of connecting walls connecting two sides of the upper wall and the lower wall;

wherein the outer grounding arms resist the upper wall or the lower wall of the outer shield outwardly.

10. A cable connector, comprising:

a single piece insulative housing;

a plurality of contacts arranged on the insulative housing, each contact having a retaining portion retained in the insulative housing, a contact portion extending into the receiving space from one end of the retaining portion, a connecting portion extending from another end of the retaining portion;

a flat cable having a plurality of wires electrically connecting with the connecting portions and a coating retaining at outside of the wires, all wires being arranged in a row and the center axes of all wires being located in a same plane;

wherein the contacts comprise a pair of differential signal contacts, and the flat cable is provided with at least a wire set corresponding to the differential signal contacts, the wire set being provided with a first wire and a second wire, each of the first wire and second wire being provided with a first conductor, a first layer wrapping the first conductor and a second layer wrapping the first layer, and the dielectric coefficient of the first layer being lower than that of the second layer.

11. The cable connector as claimed in claim 10, wherein the second layer is wave-absorbing layer.

12. The cable connector as claimed in claim 10, wherein the flat cable is provided with at least two third wires located at two sides of the wire set, each third wire has a second conductor and a third layer wrapping the second conductor, and the diameter of the second conductor is different from that of the first conductor.

13. The cable connector as claimed in claim 10, further comprising an internal circuit board connecting between the contacts and the flat cable, wherein the internal circuit board has a plurality of first golden fingers and a plurality of second golden fingers at opposite two ends thereof, the first golden fingers connecting with the connecting portions, and the second golden fingers electrically connecting with the first golden fingers.

14. The cable connector as claimed in claim 10, wherein the contacts are arranged on the insulative housing in two rows, and the contacts in two rows are identical in signal transmission and arranged reversely.

15. The cable connector as claimed in claim 14, further comprising a grounding member located between two rows of the contacts, and the locking arms electrically connecting with the middle grounding plate.

* * * * *